US007946964B2

(12) United States Patent
Gothro et al.

(10) Patent No.: US 7,946,964 B2
(45) Date of Patent: May 24, 2011

(54) ADJUSTABLE LATERAL INSTABILITY FEATURE FOR ROWING SIMULATOR

(76) Inventors: Anne G. Gothro, Omaha, NE (US); Kirby T. Myers, Springfield, VA (US)

( * ) Notice: Subject to any disclaimer, the term of this patent is extended or adjusted under 35 U.S.C. 154(b) by 0 days.

(21) Appl. No.: 12/362,309

(22) Filed: Jan. 29, 2009

(65) Prior Publication Data

US 2009/0203503 A1 Aug. 13, 2009

Related U.S. Application Data

(60) Provisional application No. 61/062,781, filed on Jan. 29, 2008, provisional application No. 61/068,773, filed on Mar. 10, 2008.

(51) Int. Cl.
*A63B 69/06* (2006.01)
*G09B 9/02* (2006.01)

(52) U.S. Cl. ..... 482/72; 482/73; 434/60

(58) Field of Classification Search ..... 482/72–73, 482/51; 434/55, 60

See application file for complete search history.

(56) References Cited

U.S. PATENT DOCUMENTS

| | | | | |
|---|---|---|---|---|
| 199,432 | A * | 1/1878 | Goldie | 482/72 |
| 2,208,083 | A * | 7/1940 | Rousseau | 434/60 |
| 3,266,801 | A | 8/1966 | Johnson | |
| 3,940,862 | A * | 3/1976 | Nishimura | 434/60 |
| 4,735,410 | A | 4/1988 | Nobuta | |
| 4,875,674 | A | 10/1989 | Dreissigacker et al. | |
| 4,889,509 | A | 12/1989 | Pohlus | |
| 4,984,986 | A | 1/1991 | Vohnout | |
| 5,092,581 | A * | 3/1992 | Koz | 482/72 |
| 6,991,589 | B1 | 1/2006 | Patterson | |
| 7,731,637 | B2 * | 6/2010 | D'Eredita | 482/72 |
| 2005/0148444 | A1 * | 7/2005 | Thomas | 482/72 |
| 2005/0233868 | A1 | 10/2005 | Mills et al. | |

FOREIGN PATENT DOCUMENTS

| | | | | |
|---|---|---|---|---|
| CA | 1215405 | A * | 12/1986 | 482/72 |

* cited by examiner

*Primary Examiner* — Steve R Crow
(74) *Attorney, Agent, or Firm* — Pandiscio & Pandiscio

(57) ABSTRACT

One embodiment of a lateral roll simulating assembly is provided which is adapted to attach to existing rowing exercise machines. It permits the user to experience various levels of physiological disequilibrium when a lack of proper balance control induces a sideways tipping action during a rowing workout. This facilitates the desirable and advantageous development of correct proprioceptive balance response using appropriate core musculature while practicing the rowing motion on a suspended rowing exercise machine. The apparatus comprises two floor-mounted members secured to each end of a rowing exercise machine that support the rowing exercise machine in a suspended condition. This assembly simulates lateral instability around the metacenter of any of a variety of rowing shells on water by allowing the rowing exercise machine to roll freely around a variety of longitudinal axes. Other embodiments are described and shown.

26 Claims, 12 Drawing Sheets

ADJUSTABLE LATERAL INSTABILITY FEATURE FOR ROWING SIMULATOR

REFERENCE TO PENDING PRIOR PATENT APPLICATIONS

This patent application claims benefit of:

(i) pending prior U.S. Provisional Patent Application Ser. No. 61/062,781, filed Jan. 29, 2008 by Anne G. Gothro et al. for LATERAL INSTABILITY FEATURE FOR ROWING SIMULATOR; and (ii) pending prior U.S. Provisional Patent Application Ser. No. 61/068,773, filed Mar. 10, 2008 by Anne G. Gothro et al. for LATERAL INSTABILITY FEATURE FOR ROWING SIMULATOR.

The two above-identified patent applications are hereby incorporated herein by reference.

FIELD OF THE INVENTION

This invention relates to rowing simulators in general, and more particularly to an adjustable lateral instability feature for a dry-land rowing simulator that simulates the side-to-side rocking motion inherent when rowing on water.

BACKGROUND OF THE INVENTION

Rowing Simulators In General

A variety of dry-land rowing simulators are well known in the art. These dry-land rowing simulators are commonly called "rowing machines" or "ergs", and allow the user to simulate, on dry land, many aspects of the on-water rowing motion. Most of these rowing simulators utilize a flywheel with an attached chain and handle, together with a sliding rowing seat that moves longitudinally along one or more rails which are supported on the ground. When the user is seated on the rowing seat, with their feet positioned on footboards and their hands grasping the handle, the rowing motion can be simulated.

Many of these prior art rowing simulators permit the rowing resistance to be adjusted via the flywheel mechanism, and/or by inclining the rail(s) upon which the seat is slidably supported. In some cases, the flywheel/chain/handle mechanism is replaced by actual oars moving (i.e., sweeping or sculling) through water tanks on either side of the rail(s).

Lateral Instability

Prior art dry-land rowing simulators are generally constructed so that the sliding seat and its supporting rail(s) are laterally stable. This construction is simple and easy to manufacture, permits the rowing simulator to be used by novices as well as experienced users, and allows the user to concentrate on the efficient application of force to the handle/oars and, as a consequence, develop the coincident muscle groups in the legs and upper torso which are related to the rowing motion. However, because the sliding seat and rail(s) are laterally stable, these prior art rowing simulators do not simulate the substantial lateral instability (i.e., rocking motion) which is normally associated with a small boat (and particularly a narrow-hulled racing shell) floating on the water. Thus, prior art dry-land rowing simulators do not help users develop the fine sense of balance which is generally required when rowing a narrow boat (e.g., a racing shell) on the water, nor do they help the user develop the coincident muscle groups in the core of the body which are associated with maintaining balance in the boat.

One problem associated with these laterally-stable rowing simulators is that when the user transitions to the water after an interval of dry-land training using these prior art rowing simulators, the user's sense of "on-water" balance must be re-learned over a period of weeks or more. This can be a significant disadvantage for users who wish to optimize their training regimen, e.g., competitive rowers. More particularly, for rowers who wish to exercise or to compete on the water, the efficient and correct application of force to the proximal end of an oar requires acquiring the fine sense of balance needed to keep the boat level throughout the entire rowing motion.

Therefore, it would be highly advantageous if a rowing simulator could help develop the user's sense of balance during dry-land training intervals. In other words, if the rowing simulator were provided with an appropriate degree of lateral (i.e., side-to-side) instability, the user would be required to acquire the balancing skills needed for on-water rowing.

In addition, non-rowing athletes seeking to develop or maintain their sense of balance with proprioception exercises could find it helpful to utilize a laterally-unstable rowing machine during their exercise regimen.

In order for a user to develop the fine balancing skills needed for rowing, it is necessary to develop the core musculature and proprioceptive balance response needed to compensate for the lateral instability inherent in narrow-hulled rowing shells. In this respect it should be appreciated that the stability, balance, and body control required to efficiently row a "single" shell is significantly more sophisticated than that required to row in an "8-person" shell, or a recreational ocean-going shell, etc.

Ideally, a training regimen designed to develop these balance skills could begin at a level of relatively high lateral stability, then gradually decrease the degree of lateral stability as the skill of the user increases. In other words, the training regimen could begin at a level of relatively low lateral instability and then gradually increase the degree of lateral instability in accordance with the growing skill of the user. Thus, the ideal rowing simulator would provide an adjustable degree of lateral instability (i.e., side-to-side "rocking" motion) about a longitudinal roll axis, preferably in indexed positions ranging from very stable to unstable.

It would also be desirable for the ideal rowing simulator to have an inclinometer to provide visual feedback to the user, and/or to be selectively lockable in a laterally-stable position when lateral instability is not desired.

Integration of such an adjustable lateral instability feature into a rowing simulator, either via retroactive attachment to a pre-existing rowing simulator or via incorporation into a newly manufactured rowing simulator, would permit a user to develop and utilize the core musculature in the trunk of the body which helps maintain balance while rowing.

The Physics of Rowing

The present invention provides unique features to address the aforementioned balance deficiencies associated with the prior art. To better understand the unique features and advantages of the present invention, it is generally helpful to have a fuller understanding of the physics of rowing.

More particularly, boats float because the downward force of gravity exactly matches the upward force of buoyancy. Gravity acts as if the total mass of the floating body (i.e., the total mass of boat and occupants) were concentrated at a single point, which is sometimes referred to as the center of gravity. Buoyancy forces also act as if applied at a single point, in an upward direction, which is sometimes referred to as the center of buoyancy.

In addition to the foregoing, several other factors relate to the physics of rowing. Among these are:

(i) The metacenter of a floating body is the intersection of buoyancy forces, represented by vertical lines, through the center of buoyancy at various roll positions. The metacenter represents the location of the longitudinal roll axis about which the floating body will rotate.

(ii) If the shape of the floating body is semi-circular in cross-section, the metacenter is simply at the center of curvature, equivalent to the center point of the described circle.

(iii) The hulls of rowing shells are generally semi-circular in cross-section, and their metacenters lie approximately at the waterline, in the vicinity of the seat of the rower.

(iv) Depending upon the size and type of rowing shell, the metacenter of a given shell can be located from inches below the seat (for narrower, smaller-diameter single sculls) to inches above the seat (for shallower, larger-diameter recreational or training shells).

(v) Whether a body floats stably or unstably on the water depends on the relative positions of the metacenter of the boat, and the combined center of gravity of the boat and rower(s). If the center of gravity of the boat and rower(s) is below the metacenter of a boat, as in the case of a hull with a wide shallow curvature, the boat will tend toward stability. However, if the center of gravity of the boat and rower(s) is above the metacenter of the boat, the boat will be unstable, and this instability will be in direct proportion to the distance between the metacenter and the center of gravity. Thus, the offset between the metacenter of the boat and the center of gravity of the boat and the rower(s) is an indication of the stability (or instability) of the boat.

OBJECTS OF THE PRESENT INVENTION

Thus it will be appreciated that rowing simulators are well known and widely used in commercial, private, collegiate and athletic club facilities. Rowing simulators enable the user to exercise their arms, shoulders, chest and legs by simulating the movements required to propel a rowing shell. However, it will also be appreciated that no rowing simulator has heretofore been devised which can simulate the lateral instability (about a longitudinal roll axis) as is found in variously-sized rowing shells, and which thereby facilitates the development of a correct proprioceptive response technique.

Specifically, none of the prior art rowing simulators includes the following combination of features:

(i) support for a training regimen that encompasses a broad range of proprioceptive skill levels, from novice to elite athlete;

(ii) choices (based on actual hull size and configurations) as to how much instability the user wishes to experience during dry-land training;

(iii) direct, exteroceptive feedback for the direction and degree of roll experienced during the rowing motion in order to facilitate learning to correct for that roll;

(iv) the potential to be used with more than one model of commercially-available rowing simulator; and (v) the option to "lock-out" the lateral instability feature from the rowing simulator in order to engage in a workout (or a portion of a workout) that does not include lateral instability.

The present invention is intended to address the deficiencies of the prior art.

SUMMARY OF THE PRESENT INVENTION

In accordance with the present invention, there is provided a lateral roll-simulating assembly adapted to be attached to a rowing simulator, wherein the lateral roll-simulating assembly comprises two stationary base members, with mounted mechanical pivots and support members, affixable one each to the forward and rear ends of a rowing simulator using an adjustable attachment provision that may be set to a variety of pre-determined positions. These pre-determined positions (for providing increased or decreased lateral stability) lie within, and beyond, the range found in typical rowing shells in order to facilitate a graduated increase or decrease in the challenge of perfecting proprioceptive balance in concert with the application of muscular power/strength. The increase or decrease of lateral stability is accomplished by moving the position of the rowing simulator, which is secured to the lateral roll-simulating assembly, up or down relative to the pivots on the lateral roll-simulating assembly. The pivots function as the longitudinal roll axis of the rowing simulator (i.e., the pivots function as the metacenter of the simulated rowing shell). Positioning the rowing simulator at a higher or lower indexed setting functionally equates to moving the center of gravity (of the user and rowing simulator) to locations above or below the longitudinal roll axis (i.e., the metacenter) of the simulated rowing shell. When this functionality is included in a dry-land workout regimen using a rowing simulator, the user is able to develop and refine the balance component of the rowing motion at various stability levels emulating different sizes of shells in the water.

The lateral rocking action of the present invention is variable in at least three ways:

(1) The user is able to select from a range of positions on the support members (which are attached to the pivots on the floor-mounted base members) so as to vary the location of the roll axis (i.e., metacenter) relative to the user's center of gravity, so as to produce a more or a less laterally-stable condition. Stated another way, the user is able to vary the center of gravity of the rowing simulator and user vis-á-vis the metacenter defined by the pivots. This feature enables the gradual development of, or continued improvement in, balance control by simulating a variety of rowing shell sizes.

(2) Like the function of training wheels on a bicycle, the user is able to set an upper limit to the allowed instability range, thereby permitting no more than a pre-determined degree of roll simulation. This limit is variable and can be adjusted incrementally up to a maximum safe allowance as the user develops increased balance proficiency.

(3) The user is able to manually "lock out" the lateral instability feature, so that no "tipping" action is permitted.

In one form of the present invention, there is provided a lateral roll-simulating assembly for supporting a rowing simulator, the lateral roll-simulating assembly comprising:

a forward base member having a forward swing arm pivotally connected thereto at a forward pivot, and a rear base member having a rear swing arm pivotally connected thereto at a rear pivot, the forward pivot and the rear pivot together defining a metacenter axis;

a forward support member comprising a forward support surface for supporting a forward end of the rowing simulator, the forward support member being adjustably secured to the forward swing arm so as to permit the user to adjust the distance between the forward support surface and the metacenter axis; and a rear support member comprising a rear support surface for supporting a rear end of the rowing simulator, the rear support member being adjustably secured to the rear swing arm so as to permit the user to adjust the distance between the rear support surface and the metacenter axis, whereby to permit the user to adjust the lateral instability of a rowing simulator mounted to the lateral roll-simulating assembly.

In another form of the present invention, there is provided apparatus for simulating an on-water rowing experience, the apparatus comprising: a rowing simulator; and a lateral roll-simulating assembly for supporting the rowing simulator, the lateral roll-simulating assembly comprising:

a forward base member having a forward swing arm pivotally connected thereto at a forward pivot, and a rear base member having a rear swing arm pivotally connected thereto at a rear pivot, the forward pivot and the rear pivot together defining a metacenter axis;

a forward support member comprising a forward support surface for supporting a forward end of the rowing simulator, the forward support member being adjustably secured to the forward swing arm so as to permit the user to adjust the distance between the forward support surface and the metacenter axis; and a rear support member comprising a rear support surface for supporting a rear end of the rowing simulator, the rear support member being adjustably secured to the rear swing arm so as to permit the user to adjust the distance between the rear support surface and the metacenter axis, whereby to permit the user to adjust the lateral instability of the rowing simulator mounted to the lateral roll-simulating assembly.

In another form of the present invention, there is provided a method for developing the lateral balance skills useful in an on-water rowing experience, the method comprising:

providing apparatus for simulating an on-water rowing experience, the apparatus comprising:

a rowing simulator; and a lateral roll-simulating assembly for supporting the rowing simulator, the lateral roll-simulating assembly comprising:

a forward base member having a forward swing arm pivotally connected thereto at a forward pivot, and a rear base member having a rear swing arm pivotally connected thereto at a rear pivot, the forward pivot and the rear pivot together defining a metacenter axis;

a forward support member comprising a forward support surface for supporting a forward end of the rowing simulator, the forward support member being adjustably secured to the forward swing arm so as to permit the user to adjust the distance between the forward support surface and the metacenter axis; and a rear support member comprising a rear support surface for supporting a rear end of the rowing simulator, the rear support member being adjustably secured to the rear swing arm so as to permit the user to adjust the distance between the rear support surface and the metacenter axis, whereby to permit the user to adjust the lateral instability of the rowing simulator mounted to the lateral roll-simulating assembly;

securing the forward support member to the forward swing arm, and securing the rear support member to the rear swing arm, so that the forward support member and the rear support member are displaced from the metacenter by a first distance;

operating the rowing simulator; and re-securing the forward support member to the forward swing arm, and re-securing the rear support member to the rear swing arm, so that the forward support member and the rear support member are displaced from the metacenter by a second distance, the second distance being different than the first distance.

In another form of the present invention, there is provided a lateral roll-simulating assembly for supporting a rowing simulator, the lateral roll-simulating assembly comprising:

a first base member having a first support member movably connected to the first base member about a first pivot point, the first support member being adapted to support a first end of the rowing simulator;

a second base member having a second support member movably connected to the second base member about a second pivot point, the second support member being adapted to support a second end of the rowing simulator;

the first pivot point and the second pivot point together defining a metacenter axis; and the first support member and the second support member being movable relative to the metacenter axis in order to permit the user to modify the position of the center of gravity of the user and the rowing simulator relative to the metacenter axis, whereby to the adjust the lateral instability of the rowing simulator mounted to the lateral roll-simulating assembly.

In another form of the present invention, there is provided a method for developing the lateral balance skills useful in an on-water rowing experience, the method comprising:

providing apparatus for simulating an on-water rowing experience, the apparatus comprising:

a rowing simulator; and a lateral roll-simulating assembly for supporting a rowing simulator, the lateral roll-simulating assembly comprising:

a first base member having a first support member movably connected to the first base member about a first pivot point, the first support member being adapted to support a first end of the rowing simulator;

a second base member having a second support member movably connected to the second base member about a second pivot point, the second support member being adapted to support a second end of the rowing simulator;

the first pivot point and the second pivot point together defining a metacenter axis; and the first support member and the second support member being movable relative to the metacenter axis in order to permit the user to modify the position of the center of gravity of the user and the rowing simulator relative to the metacenter axis, whereby to the adjust the lateral instability of the rowing simulator mounted to the lateral roll-simulating assembly;

positioning the first support member and the second support member in a first position relative to the metacenter axis, wherein the first support member and the second support member are spaced from the metacenter axis by a first distance, and positioning the first end of the rowing simulator on the first support member, and positioning the second end of the rowing simulator on the second support member;

operating the rowing simulator; and re-positioning the first support member and the second support member in a second position relative to the metacenter axis, wherein the first support member and the second support member are spaced from the metacenter axis by a second distance, the second distance being different than the first distance.

BRIEF DESCRIPTION OF THE DRAWINGS

Further features, details, advantages and effects of the present invention will become apparent from the following detailed description of the preferred embodiments of the invention, which is to be considered together with the attached drawings wherein like numbers refer to like parts, and further wherein.

DETAILED DESCRIPTION OF THE PREFERRED EMBODIMENTS

Figure 1:
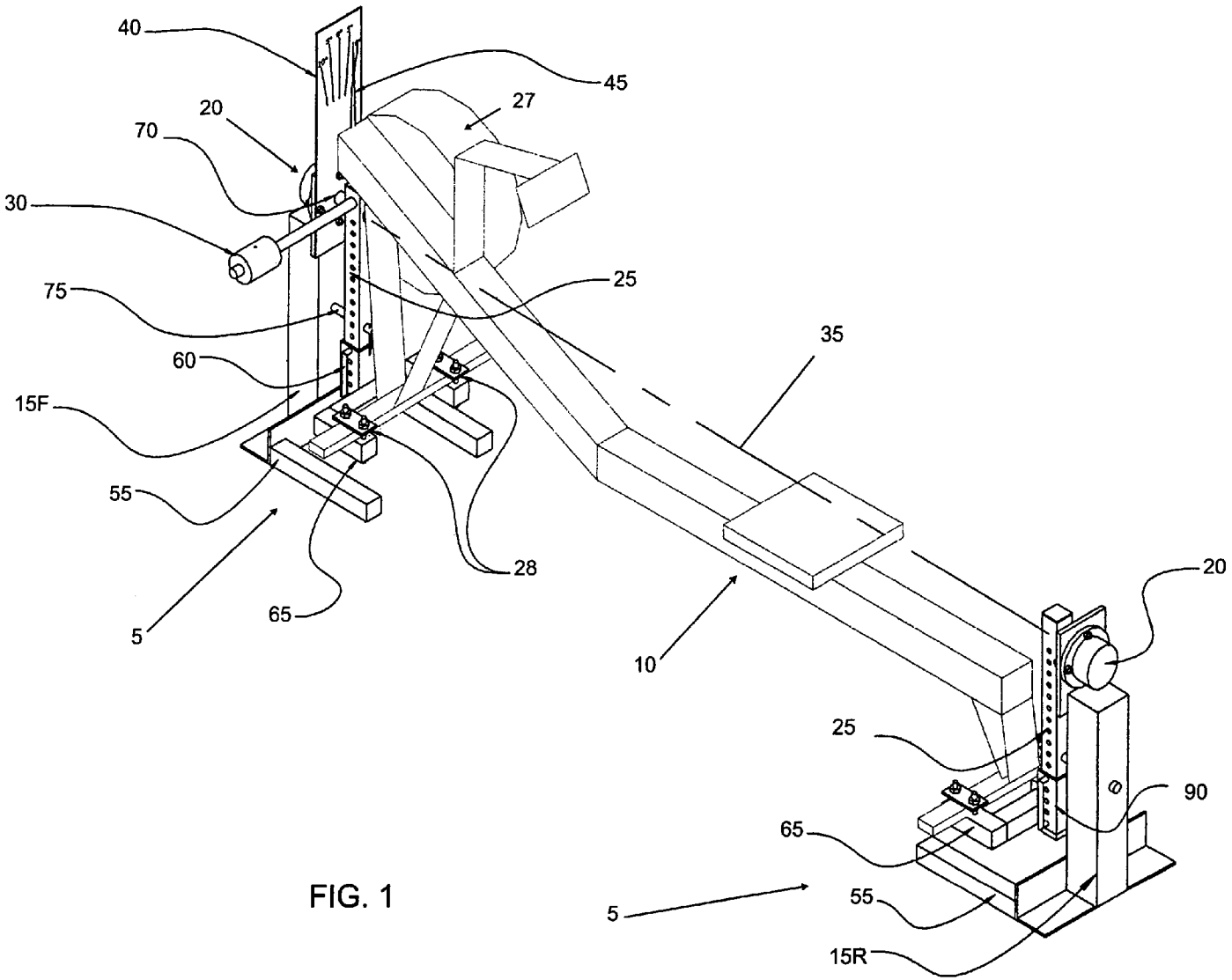
FIG. 1 is a perspective view of a rowing simulator mounted on a lateral roll-simulating assembly in accordance with the present invention.

FIG. 1 shows a lateral roll-simulating assembly 5 having a rowing simulator 10 attached thereto. As shown, lateral roll-simulating assembly 5 is configured to stand on the floor and support each end of rowing simulator 10 elevated above the floor and provide rowing simulator 10 with a selected degree of lateral instability.

Lateral roll-simulating assembly 5 comprises a forward stationary base member 15F and a rear stationary base member 15R. Forward stationary base member 15F and rear stationary base member 15R each include a pivot 20. Swing arms 25 are pivotally attached at each of the pivots 20 so that swing arms 25 are normally permitted to pivotally swing relative to the base members.

Where a rowing simulator utilizes a side-mounted flywheel (e.g., flywheel 27 in FIG. 1), a weighted mass 30 is provided on one side of one of the swing arms 25 so as to provide a compensating counterweight for the side-mounted flywheel, whereby to effect lateral balance along the longitudinal midline of the rowing simulator (i.e., along the longitudinal axis 35 extending through pivots 20).

An exteroceptive feedback mechanism, such as an inclinometer, can be integrated into the free-swinging relationship between forward stationary base member 15F and forward swing arm 25. By way of example but not limitation, a stationary gauge plate 40 can be mounted to forward stationary base member 15F, and a moving pointer 45 can be mounted to forward swing arm 25, so that the degree of tilt between forward swing arm 25 and forward stationary base member 15F can be visually indicated to a user. Preferably, the inclinometer is in the direct line of sight of a user seated on rowing simulator 10, which is secured to lateral roll-simulating assembly 5.

Figure 2:
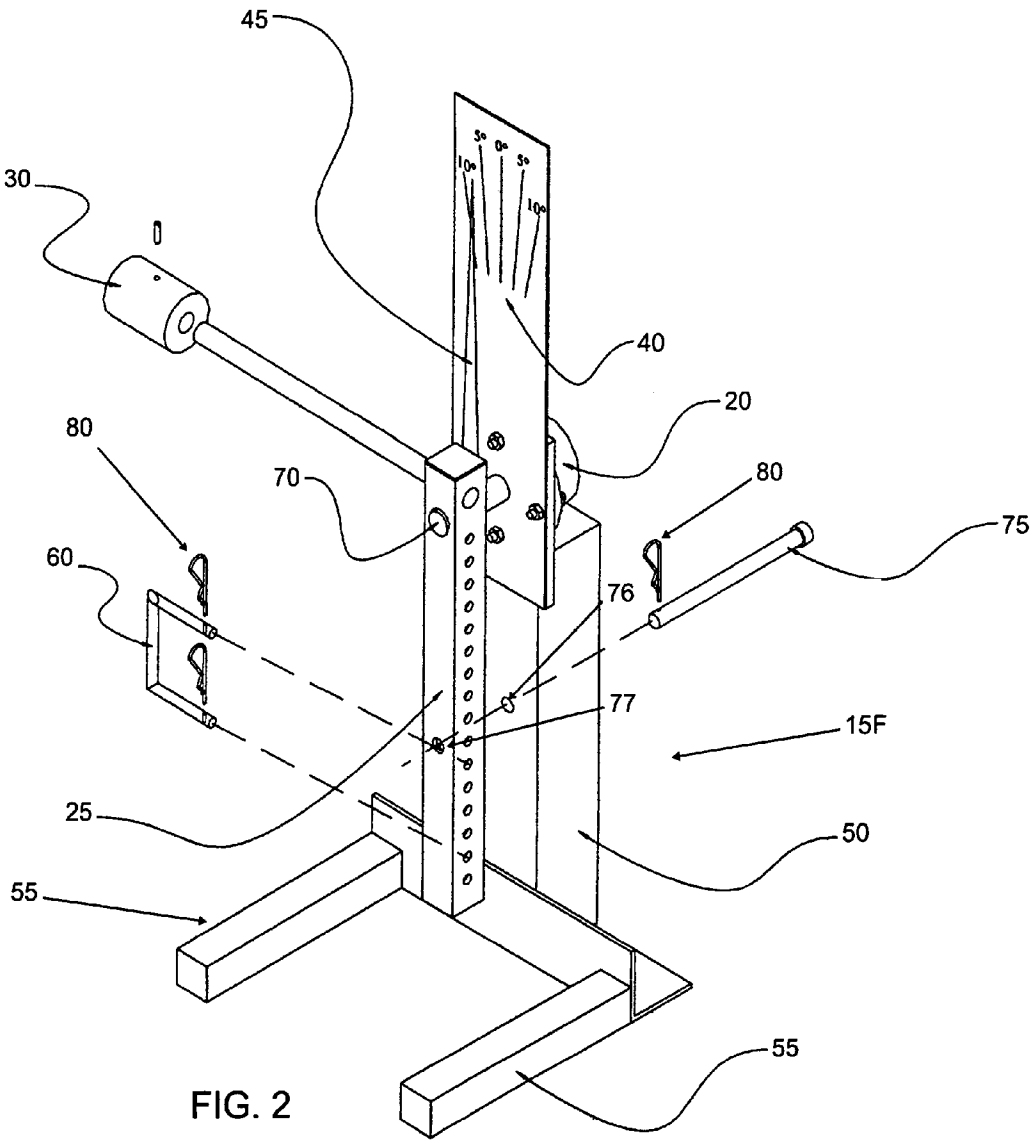
FIG. 2 is a perspective view of the forward stationary base member of the lateral roll-simulating assembly shown in FIG. 1.
Figure 3:
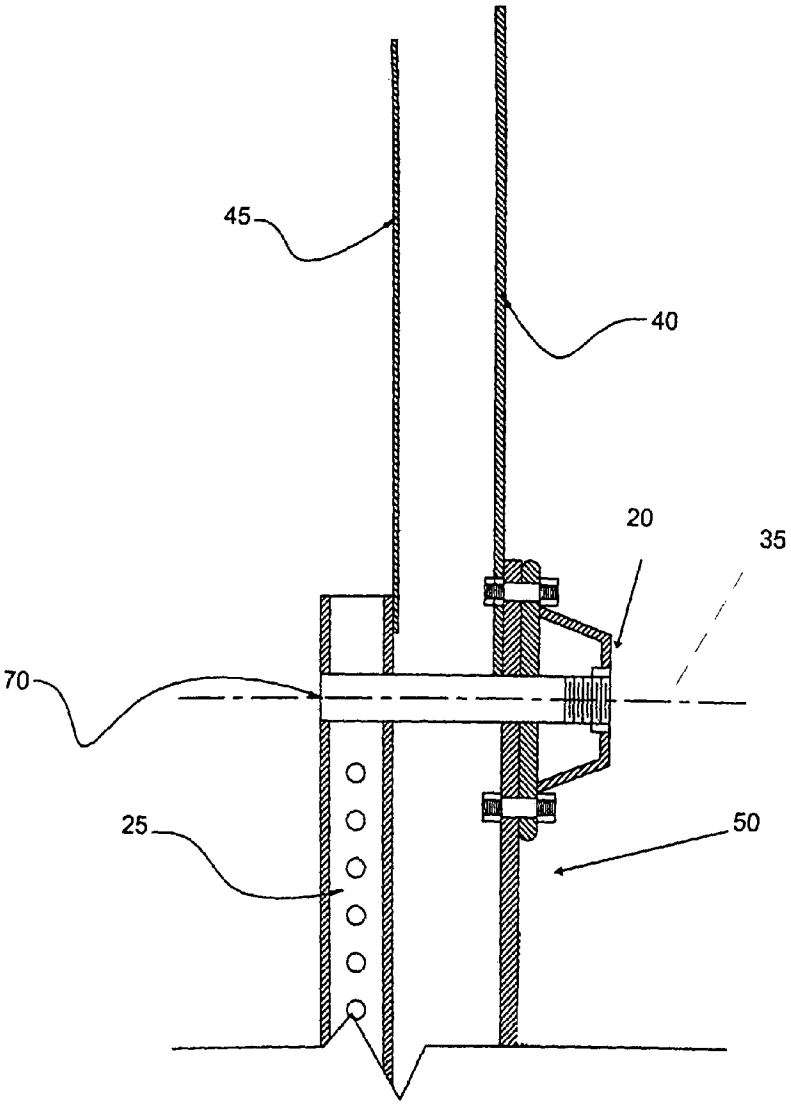
FIG. 3 is a side cross-sectional view, taken through the pivot of the stationary base member shown in FIG. 2.

As seen in FIG. 2, forward stationary base member 15F comprises a vertical post 50 and two floor support arms 55. Pivot 20 is mounted to the upper end of vertical post 50. A C-shaped fastener 60 (or a functionally equivalent means) is provided for adjustably mounting a support member 65 (not shown in FIG. 2, but shown in FIG. 1) to swing arm 25, as will hereinafter be discussed in further detail. It will be appreciated that vertical post 50, two floor support arms 55, the inclinometer's stationary gauge plate 40 and the housing of pivot 20 are permanently secured together as a single assembly. Swing arm 25, moving pointer 45, pivot shaft 70 and weighted mass 30 are all secured together as another single assembly. Swing arm 25 is secured to pivot shaft 70 in a manner that permits swing arm 25 to rotate about pivot shaft 70, i.e., about the roll axis 35 shown in FIGS. 1 and 3.

Figure 7:
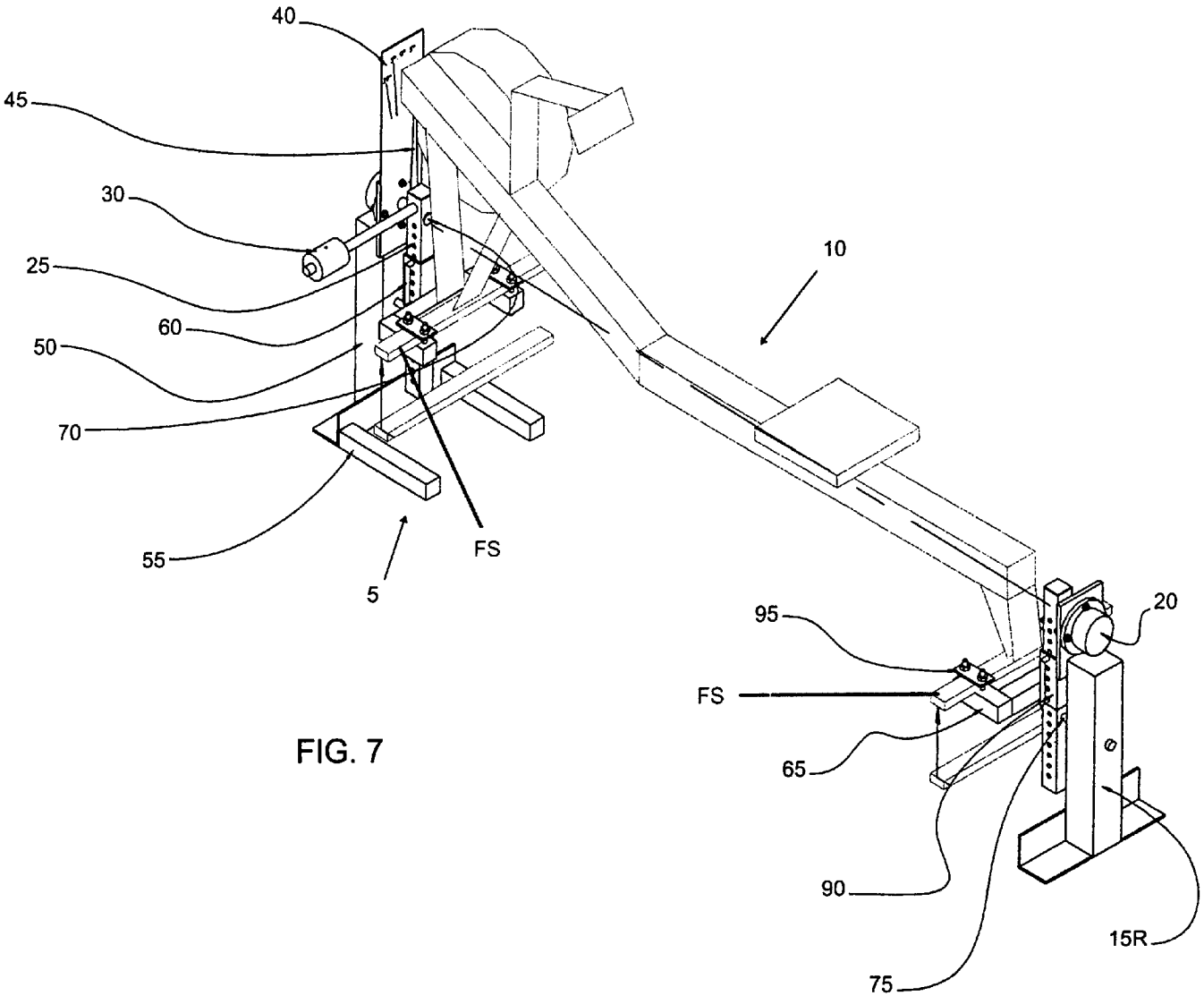
FIG. 7 is a view like that of FIG. 1, with the lateral roll-simulating assembly locked in its "no tipping" condition.

A lock pin 75 (FIG. 2) is optionally provided to secure swing arm 25 to vertical post 50, by insertion into matching parallel holes 76 (in vertical post 50) and 77 (in swing arm 25). See, for example, FIGS. 5 and 7, where lock pin 75 locks swing arm 25 to vertical post 50. This action disables the lateral instability feature of the present invention. Lock pin 75 is removable by the user when the lateral instability feature is to be restored. A cotter pin 80, or a functionally equivalent means, may be used to secure lock pin 75 in position relative to vertical post 50 and swing arm 25.

Figure 6:
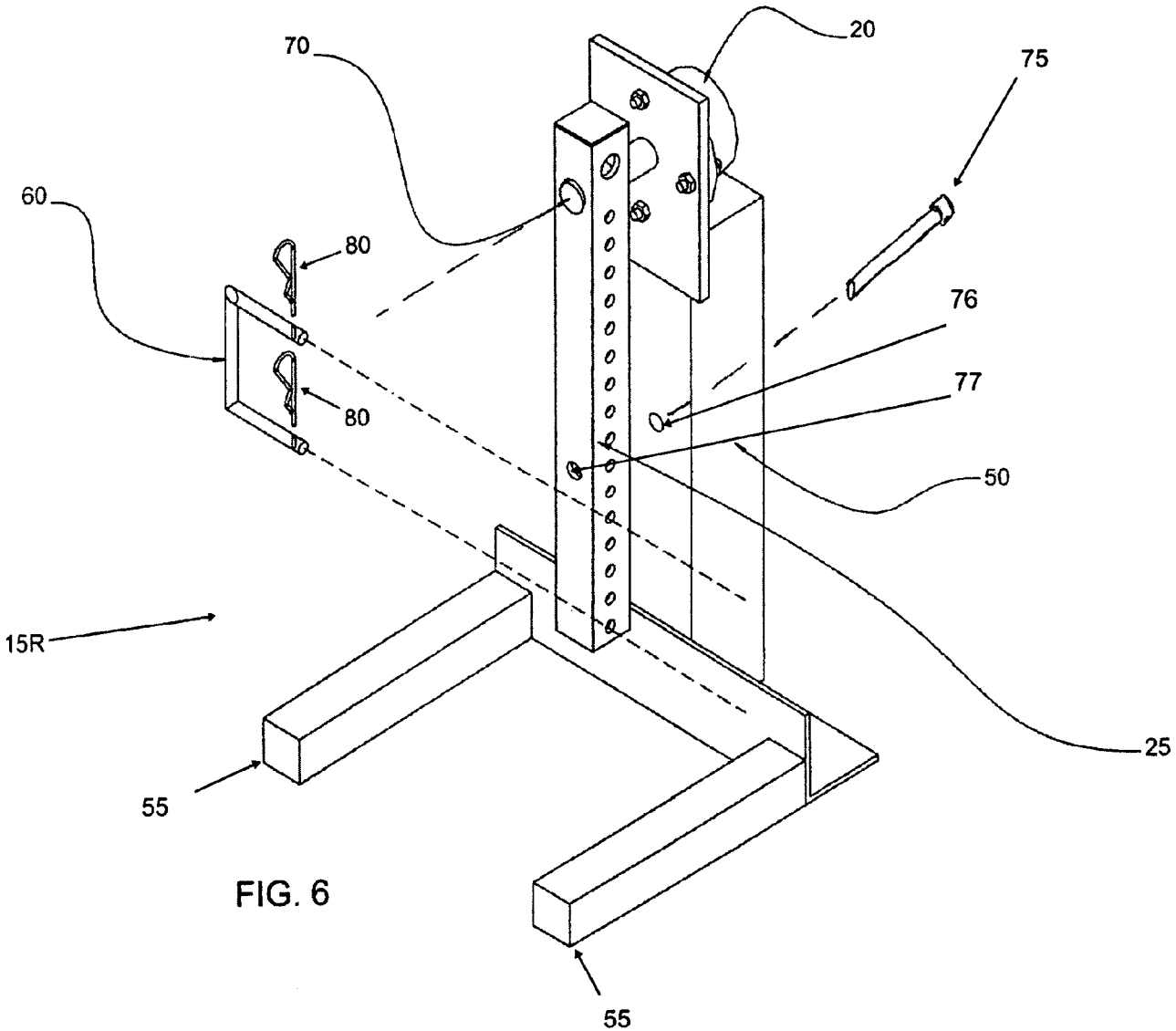
FIG. 6 is a perspective view of the rear stationary base member of the lateral roll-simulating assembly shown in FIG. 1.

Rear stationary base member 15R is shown in greater detail in FIG. 6. Rear stationary base member 15R is preferably identical to front stationary base member 15F, except that rear stationary base member 15R lacks the inclinometer (40, 45) and the weighted mass 30 of front stationary base member 15F.

Figure 4:
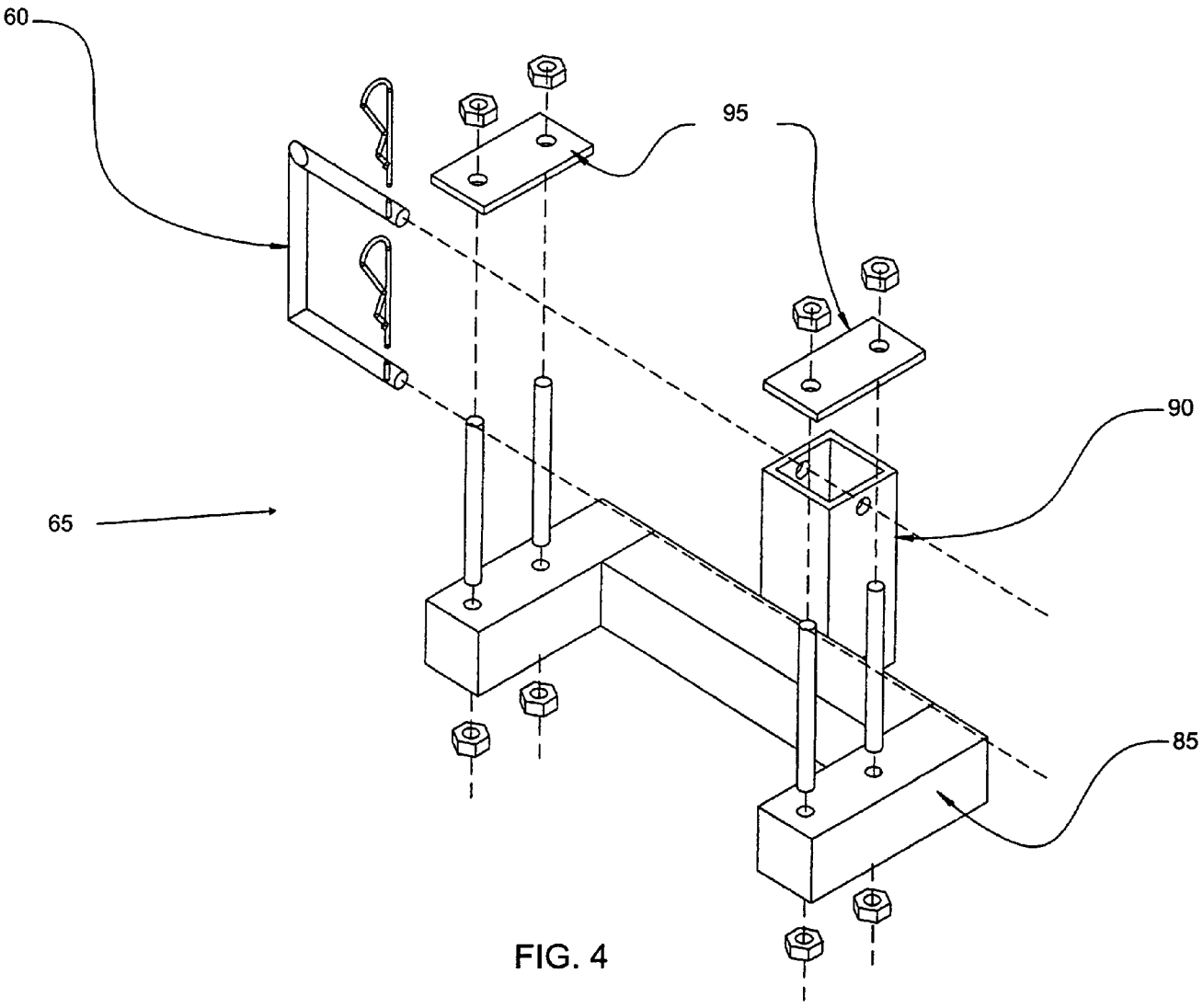
FIG. 4 is an exploded perspective view of a support member incorporated into the lateral roll-simulating assembly and adapted to support the rowing simulator.

Forward and rear support members 65 are preferably identical to one another. Forward support member 65 is illustrated in FIG. 4. Forward and rear support members 65 each comprise a rowing simulator mount 85 (e.g., two arms attached to a crosspiece), a vertical sleeve 90 for engagement with a swing arm 25 as will hereinafter be discussed, and two securing plates 95 (or a functionally equivalent means) for capturing the feet of rowing simulator 10 to a support member 65.

Figure 5:
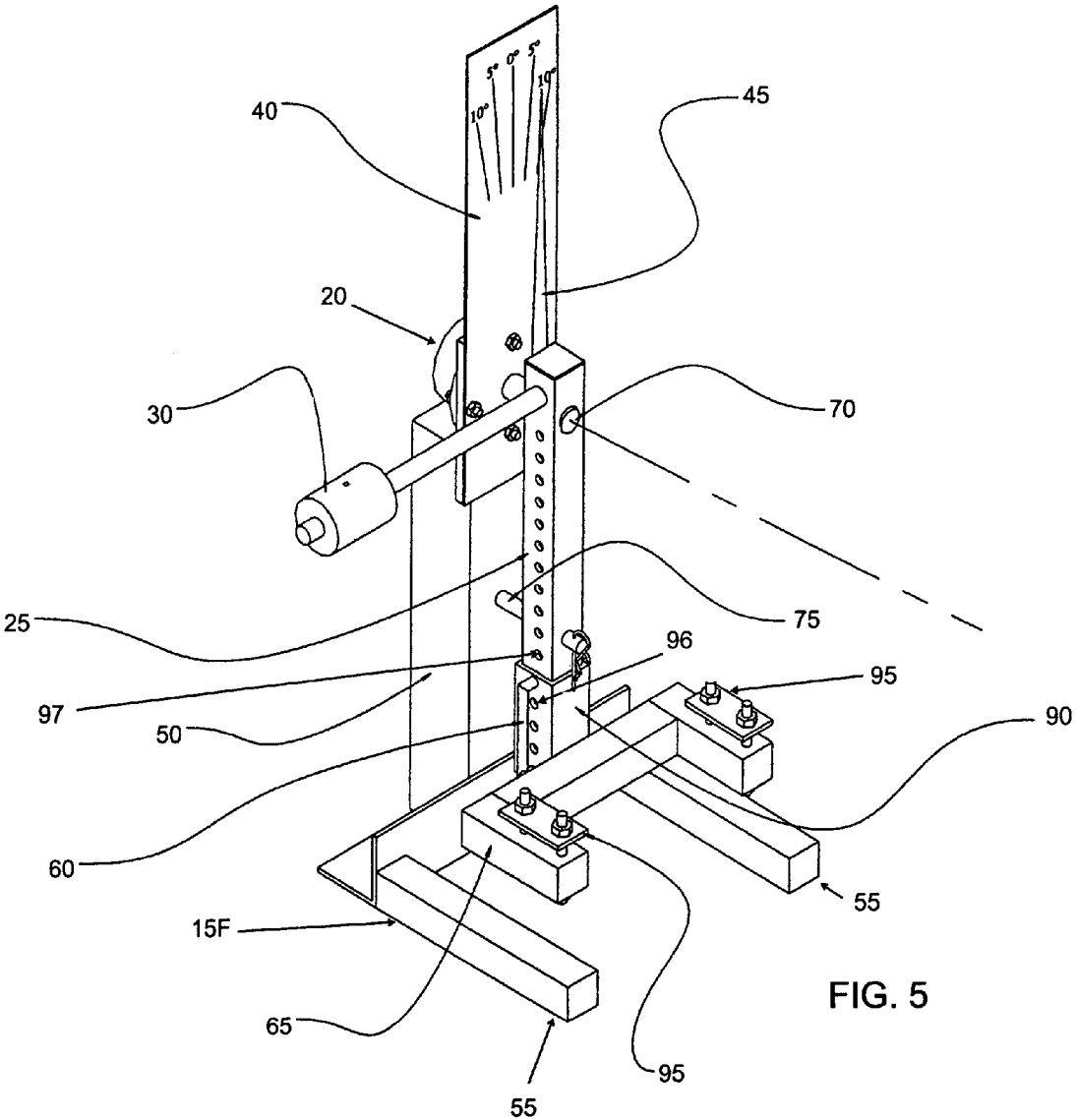
FIG. 5 is a perspective view showing the forward stationary base member of FIG. 2, with the support member of FIG. 4 attached thereto.

FIG. 5 illustrates forward support member 65 attached to forward stationary base member 15F. This is done by sliding vertical sleeve 90 telescopically over swing arm 25, and securing it in a desired position by passing a C-shaped fastener 60 through holes 96 in vertical sleeve 90 and holes 97 in swing arm 25. The holes 97 in swing arms 25 and the holes 96 in vertical sleeves 90 (in both front and rear supports) are indexed so as to allow a rowing simulator 10 to maintain a level pitch (front-to-rear) when attached to lateral roll-simulating assembly 5. Cotter pins 80 (FIG. 6), or a functionally equivalent means, may be used to secure C-shaped fastener 60 to vertical sleeves 90 and swing arms 25. In use, the user removes C-shaped pins 60, properly positions front and rear vertical sleeves 90 relative to front and rear swing arms 25, replaces C-shaped pins 60, and then secures cotter pins 80 in order to set the center of gravity of the user plus rowing simulator relative to longitudinal axis 35 (i.e., the simulated metacenter defined by pivots 20), whereby to adjust the degree of lateral instability desired for training.

It should also be appreciated that FIG. 5 shows forward stationary base member 15F and forward support member 65 with lock pin 75 in place (i.e., so that the lateral instability feature of the present invention is disabled). In this respect it should also be appreciated that it may be helpful to lock swing arms 25 to vertical posts 50 before adjusting the positions of vertical sleeves 90 vis-à-vis swing arms 25.

Securing plates 95 secure the floor supports (i.e., feet) FS (FIG. 7) of rowing simulator 10 to mounts 85 at both the forward and rear stationary base members 15F, 15R.

In operation, the dashed line 35 (FIG. 1) extending from pivot 20 of forward stationary base member 15F to pivot 20 of rear stationary base member 15R represents the metacenter of the rowing simulator (i.e., the metacenter of the rowing shell which is to be simulated). It will be evident from FIG. 7 that raising support members 65 on swing arms 25 of the forward and rear stationary base members 15F, 15R raises the center of gravity of the user plus rowing simulator relative to metacenter 35, whereby to increase the lateral instability of the apparatus. This is because the distance between (i) the center of gravity of the user plus rowing simulator (which is typically located at approximately the navel of the user, which is commonly above the metacenter), and (ii) the roll axis (metacenter) of the apparatus is increased. Such increased instability is useful for simulating a smaller shell, such as a single scull which has a relatively large degree of lateral instability. To simulate a larger shell, such as a four-, or eight-person shell, which has a lesser degree of lateral instability, forward and rear support members 65 are lowered on their respective swing arms 25 so as to decrease the distance between the center of gravity of the user plus rowing simulator (again, which is typically located at approximately the navel of the user, which is commonly above the metacenter) and the roll axis (metacenter).

Figure 8:
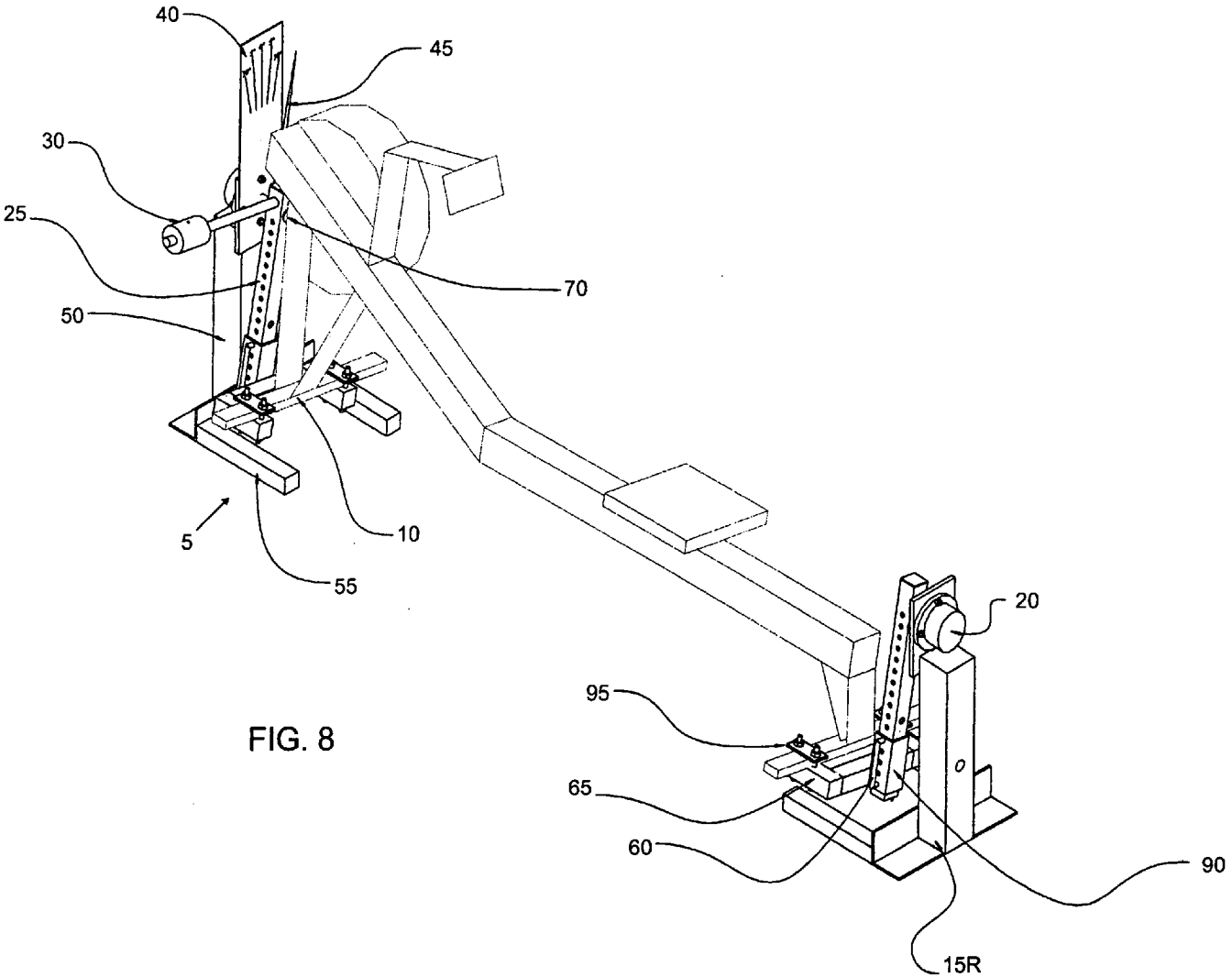
FIG. 8 is a perspective view like that of FIG. 7, except with the lateral roll-simulating assembly tilted to demonstrate lateral roll.

The user learns through practice to balance by minimizing lateral roll. To do this, the user keeps an eye on the inclinometer, and tries to maintain the inclinometer indicator hand as close to zero degrees tilt as possible. FIG. 8 illustrates rowing simulator 10 in a tilted position reflecting an out-of-balance condition.

Thus, in use, the user adjusts the location of support members 65 to position rowing simulator 10 at the desired spatial relationship with respect to longitudinal roll axis (i.e., metacenter) 35 (which is formed by pivots 20 on forward and rear stationary base members 15F, 15R). To simulate a larger and more stable rowing shell, such as a four-, or eight-person shell, the forward and rear support members 65 are lowered on their respective stationary base members until the rowing simulator 10 is in the correct spatial relationship to metacenter 35 to simulate the roll propensity of the desired shell. In other words, to simulate a more-stable rowing shell, forward and rear support members 65 are moved downward on swing arms 25 (i.e., by moving vertical sleeves 90 downward on swing arms 25) so as to decrease the distance between the center of gravity of the user and rowing simulator vis-à-vis the longitudinal roll axis (or metacenter) 35 of the simulated shell. Conversely, to simulate a smaller, less stable shell such as a single scull, forward and rear support members 65 are raised so as to increase the distance between the center of gravity of the user and the rowing simulator and the longitudinal roll axis (or metacenter) 35 of the simulated shell and thereby to introduce the increased lateral instability associated with such a single scull.

For a new or inexperienced user, unaccustomed to experiencing lateral roll, the forward and rear support members 65 are lowered (i.e., moved away from metacenter 35) so that more stability is attained. Forward and rear support members 65 are then raised, in small increments, over the course of a training program involving many workouts so as to progressively increase the lateral instability presented to the user. If a particular training regimen requires some portion of the workout to be accomplished without any lateral instability, lock pins 75 are employed in the manner previously discussed, or the rowing simulator is simply removed from lateral roll-simulating assembly 5.

Figure 9:
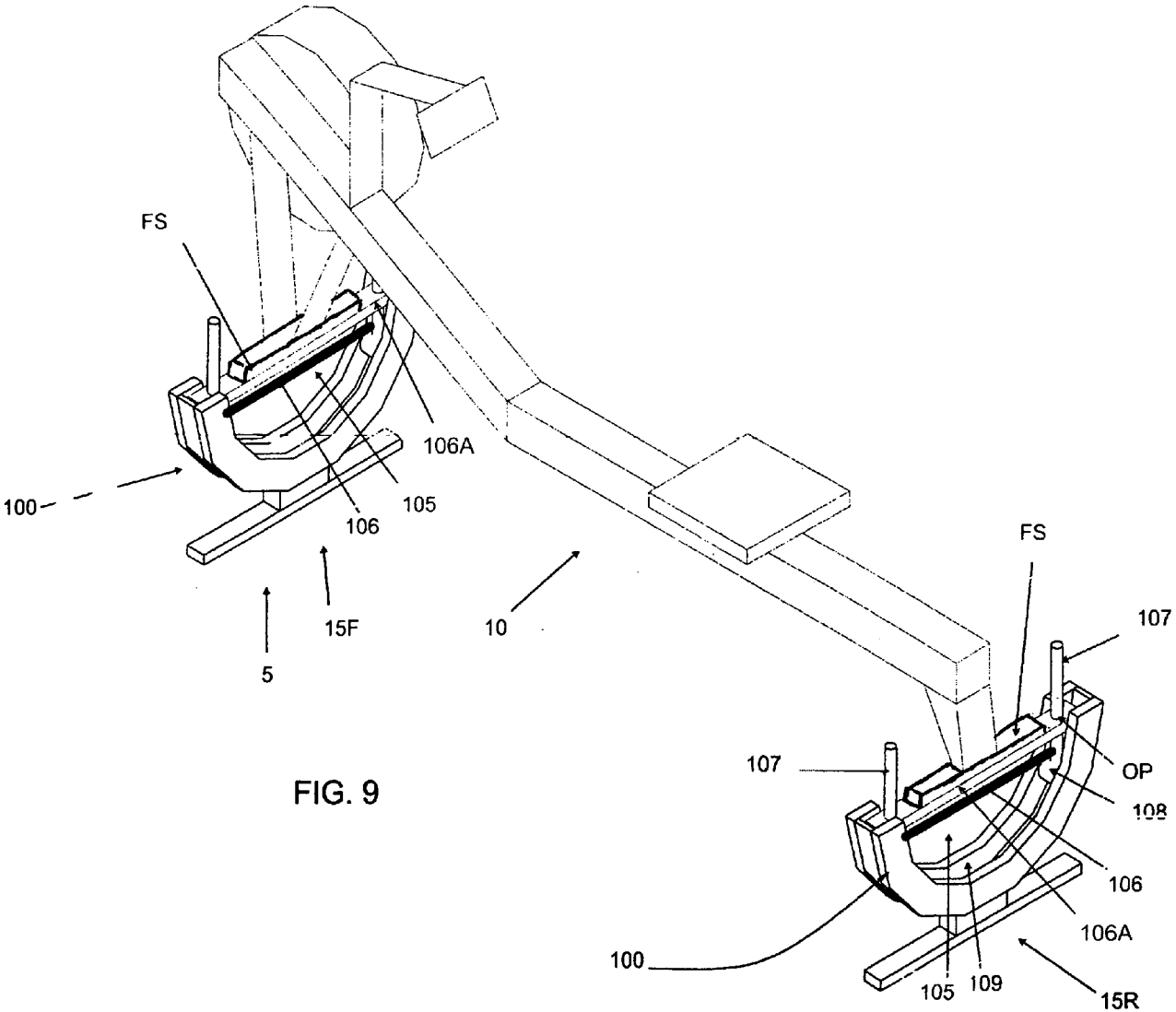
FIG. 9 is a perspective view of a rowing simulator mounted on an alternative form of the lateral roll-simulating assembly.
Figure 10:
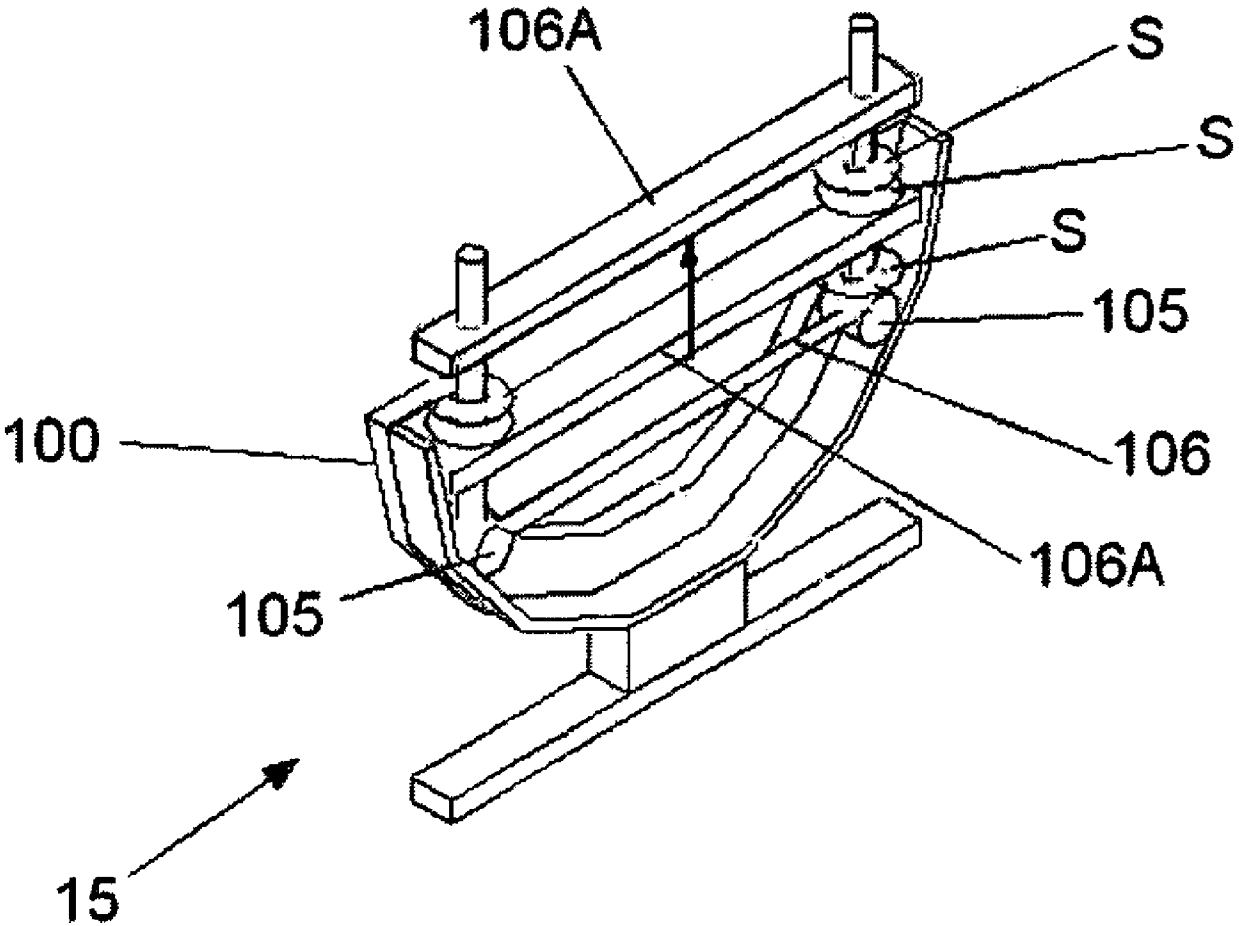
FIG. 10 is a perspective view of the floor-mounted arced track and the wheeled mounting mechanism of the lateral roll-simulating assembly shown in FIG. 9.

FIGS. 9 and 10 illustrate an alternative form of the present invention. In this construction, front and rear stationary base members 15F, 15R comprise a floor-mounted arced track 100 within which a wheeled mounting mechanism 105 is movably disposed. Wheeled mounting mechanism 105 preferably comprises a lower cross-bar 106 which rigidly connects a pair of vertical risers 107. An upper cross-bar 106A, having a pair of openings OP, is slidably mounted on vertical risers 107. Wheels (or sliders) 108 are formed at the bottoms of vertical risers 107 and ride in a groove 109 formed in arced track 100. Wheeled mounting mechanism 105 supports rowing simulator 10 in an adjustable manner. More particularly, rowing simulator 10 has its floor supports FS secured to upper cross-bar 106A, whereby to mount rowing simulator 10 on wheeled mounting mechanism 105. Spacers S (FIG. 10) (e.g., toroidal shaped bodies) of varying sizes can be mounted on vertical risers 107, whereby to permit adjustment of the vertical disposition of upper cross-bar 106A, and hence rowing simulator 10, relative to arced track 100. In this way, the center of gravity of the user and the rowing simulator vis-à-vis the simulated metacenter of floor-mounted arced track 100 can be adjusted as desired, whereby to adjust the degree of lateral instability of the system. This embodiment lacks pivots 20 of the previous construction, and relies upon the adjustable mounting of floor supports FS on wheeled mounting mechanism 105 in order to vary the relationship between the rowing simulator and the axis of rotation or metacenter (which is established by the center of the circle defined by the curvature of arced track 100).

When using the construction of FIGS. 9 and 10, the user adjusts the setting (i.e., the vertical disposition) of floor supports FS of rowing simulator 10 relative to arced tracks 100 in order to position the rowing simulator in the correct spatial relation with respect to the longitudinal roll axis effected by an imaginary line connecting the centers of imaginary circles intimated by the forward and rear floor-mounted arced tracks 100. To simulate larger (i.e., more stable) watercraft, the forward and rear wheeled mounting mechanisms 105 are lowered on the respective floor-mounted arced tracks 100, until the rowing simulator is in the correct spatial relation to the longitudinal axis of the arced tracks 100. Conversely, to simulate smaller (less stable) watercraft, the forward and rear wheeled mounting mechanisms 105 are raised (see FIG. 10). For a new or inexperienced user, unaccustomed to experiencing lateral roll, the forward and rear wheeled mounting mechanisms 105 are lowered so that more stability is attained, and then raised in small increments over the course of a training program involving many workouts so as to progressively increase the degree of lateral instability presented to the user. If a particular training regimen requires some portion of the workout to be accomplished without any lateral instability, the forward and rear wheeled mounting mechanisms 105 are lowered all the way down so that the rowing simulator rests directly on lock points on the arced track (see FIG. 10, where the lower element rests directly on the arced tracks).

Figure 11:
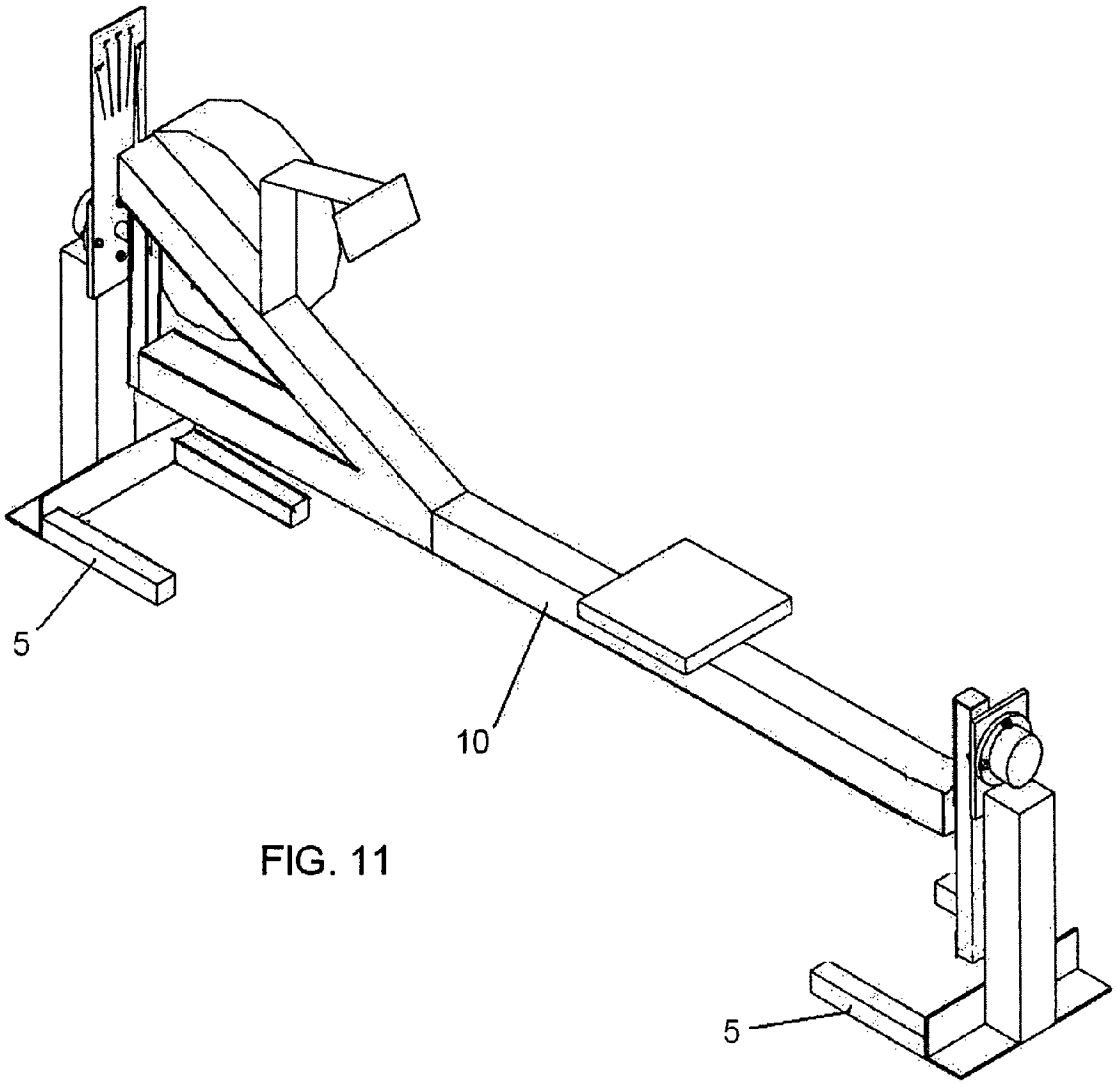
FIG. 11 is a perspective view of another form of the present invention, wherein the rowing simulator is formed integral with a lateral roll-simulating assembly.
Figures 12, 13:
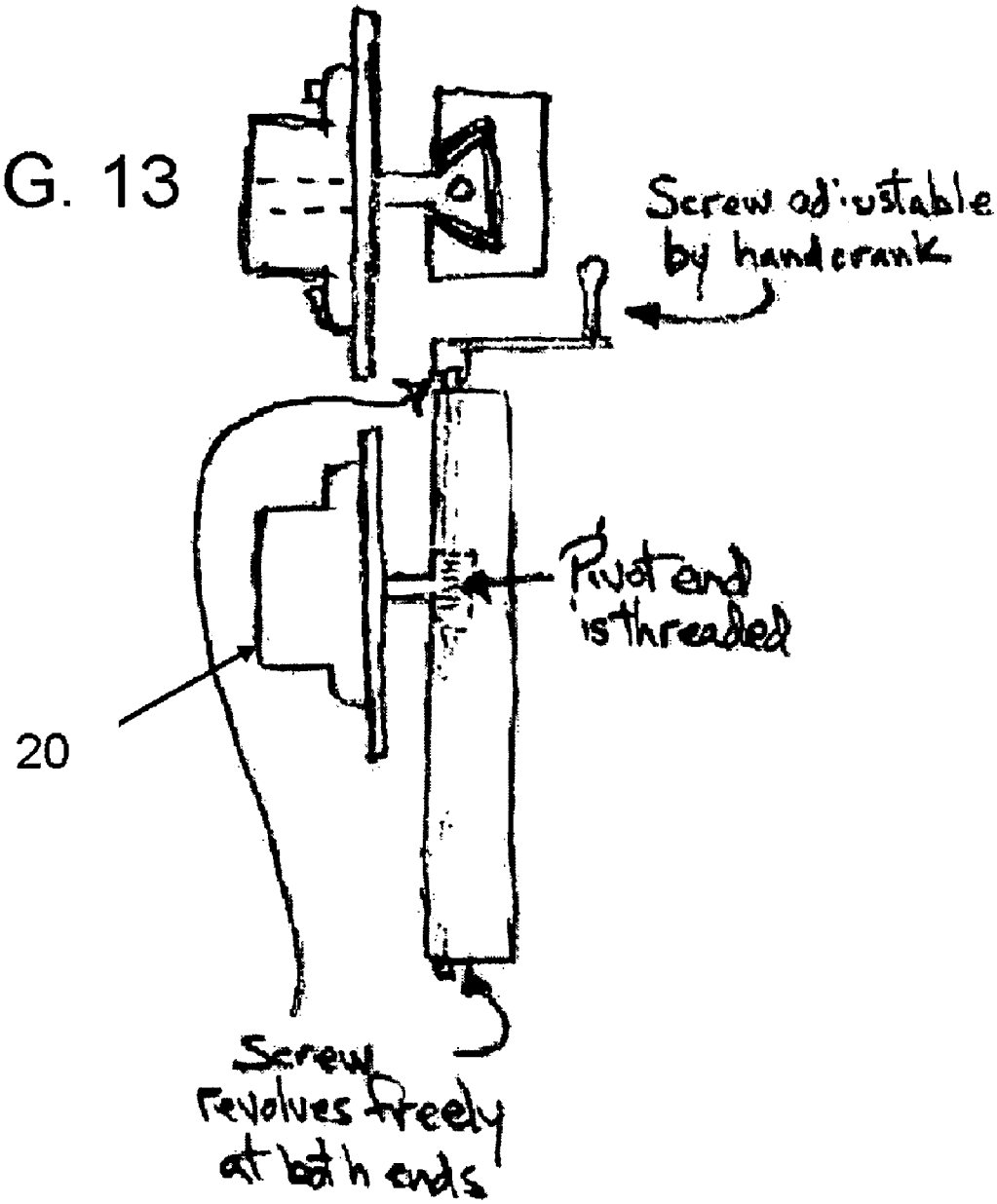
FIG. 12 is a side view of selected portions of the apparatus of FIG. 11.
FIG. 13 is a top view of selected portions of the apparatus of FIG. 11.

In the foregoing descriptions, the present invention is discussed in the context of a lateral roll-simulating assembly 5 having a rowing simulator 10 secured thereto. It is also apparent that the features and functionality of the present invention may also be fully integrated into the design of a unitary rowing simulator, such that one integral product comprises all of the features and functionality of the lateral roll-simulating assembly 5 in addition to the features and functionality of the typical laterally-immobile rowing simulator currently in common use. Thus, for example, FIG. 11 shows a device in which lateral roll simulating assembly 5 is formed integral with rowing simulator 10.

FURTHER ASPECTS OF THE INVENTION

1. Minimizing Drag

Racing rowing shells involves maximizing propulsion and minimizing drag. While the rowers are the propulsion of a rowing shell, the "friction" with the water is the greatest drag. In order to minimize drag, it is generally desirable to (i) minimize the size of the shell without compromising its ability to safely carry its load, and (ii) minimize the surface area of the hull in contact with the water. The hull shape determines the amount of contact surface area. A hull shape can be a V, a U, or many other variations, depending on the designer's objective. However, it has been determined that the minimum hull surface area is always circular. So rowing shell designers generally design their racing shells with a circular lateral curvature.

2. Metacenter and Pivot

Any shell having a circular lateral curvature will rotate around the center of the defined circle just like a floating log will spin. In nautical parlance, the point of rotation is called the metacenter. Therefore, the location of the metacenter on any given racing shell has nothing to do with whether the shell is in the water or what the load in the shell may be. Rather, the location of the metacenter depends only on the size of the shell (e.g., single, double, quad or eight) and the shape of the hull (e.g., circular). Because of this, one can measure the diameter of any racing shell and determine the location of its metacenter. The present invention replicates the racing shell's metacenter with the mechanical pivot discussed above.

3. Matching Dry-Land Training To The On-The-Water Experience

The length of the swing arms, the placement of the adjustable cradle, and the consequent relationship (i.e., vertical distance and direction) between the seat of the rowing simulator and the aforementioned mechanical pivot facilitates the ability of a user to match the instability of the rowing simulator to the instability of any racing shell, regardless of size. In other words, the present invention permits the instability of the rowing simulator to be adjusted so that it can match the lateral instability of any particular racing shell. This is a significant advance over the prior art.

4. Gain The Balance Skills Gradually

Because the present invention permits the instability of the rowing simulator to be adjusted by the user, balance training can be incremental, permitting a novice user to slowly gain the substantial balance skills which may be required for competitive rowing.

5. The Solution

The present invention provides a combination of features which include (i) choices based on actual hull size for how much instability the user wishes to accommodate during dry-land training, and (ii) direct, exteroceptive feedback for the direction and degree of roll experienced during the rowing motion in order to facilitate learning to correct that roll.

The present invention comprises a watercraft-inspired lateral instability simulator, i.e., a lateral roll simulating assembly adapted to be attached to a rowing simulator (either at the time of manufacture or retroactively). In one embodiment, the present invention comprises two stationary base members with mounted mechanical pivots and support members that are attached to the forward and rear ends of the rowing simulator. The forward and rear pivots function together as the longitudinal roll axis (i.e., the metacenter) of the assembly. The relative positioning of the rowing simulator to the mount pivots may be set to a variety of pre-determined positions. Positioning the rowing simulator at a higher or lower indexed setting functionally equates to moving the center of gravity (of the user and the rowing simulator) to locations above or below the longitudinal roll axis of the device (i.e., the simulated metacenter of a rowing shell). These positions for increased or decreased stability lie within, and beyond, the range found in typical rowing shells in order to facilitate a graduated increase or decrease in the challenge of balance in concert with the application of muscular power/strength.

ADVANTAGES OF THE PRESENT INVENTION

The present invention provides numerous advantages over the prior art. Among these advantages are:

(1) the present invention facilitates correct proprioceptive balance response training for all skill levels, from novice rower to elite athlete;

(2) balance training is integrated with the strength training features of standard rowing simulators in a way that permits the user to create a graduated training regimen that focuses on balance and strength at the same time, or independently, as best suits the training objectives of the user;

(3) the present invention allows rowers to return to the water after a period of dry-land training with competency and physiological conditioning in balance skills that provides a competitive advantage;

(4) the present invention provides rowers with the feedback they need to identify and ameliorate consistent balance errors that correlate to specific steps within the stroke cycle;

(5) the present invention may be attached to an existing rowing simulator, such as may already be owned by the user, or the user's exercise facility, obviating the need to acquire an expensive new rowing simulator;

(6) the present invention may be attached to a variety of models of rowing simulators; and (7) it is anticipated that use of this device in any of its embodiments could contribute to a reduction in the occurrence or severity of lumbar and lumbopelvic injuries that are incident to motions typifying poor balance control.

Thus it will be seen that any training regimen for the sport of rowing that involves dry-land training alternated with on-the-water training should ideally encompass the development of the same sets of skills during both periods. Not to do so is to risk injury associated with required, but undeveloped, skills, and forgoes the competitive advantage of those who begin on-the-water training fully prepared. Rowing simulators in common use provide excellent training for the strength needed to propel a rowing shell through the water. However, to train a rower in the balance skills needed for rowing, it is necessary to develop the core trunk muscles and proprioceptive balance response that compensate for the intrinsic lateral instability of the rowing shell. The present invention simulates the lateral rolling motion around the metacenter of rowing shells, and includes the ability to adjust lateral instability so as to simulate the characteristics of rowing shells of various sizes. It is designed to supplement existing rowing exercise equipment to enhance a complete dry-land training regimen.

MODIFICATIONS

Although the description above contains many specificities, these should not be construed as limiting the scope of the embodiment but as merely providing illustrations of some of the presently preferred embodiments. For example, the apparatus which simulates a longitudinal axis may take other forms involving roll within a circle or arc; the exteroceptive feedback mechanism that indicates out-of-balance conditions may be a ball-in-liquid device mounted directly on rowing simulator, or may be incorporated programmatically into a rowing simulator existing electronic feedback panel, or may involve auditory or other exteroceptive mechanisms rather than a visual mechanism.

Thus it will be appreciated that, although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

What is claimed is:

1. A lateral roll-simulating assembly for supporting a rowing simulator, the lateral roll-simulating assembly comprising:

a forward base member having a forward swing arm pivotally connected thereto at a forward pivot, and a rear base member having a rear swing arm pivotally connected thereto at a rear pivot, the forward pivot and the rear pivot together defining a metacenter axis;

a forward support member comprising a forward support surface for supporting a forward end of the rowing simulator, the forward support member being adjustably secured to the forward swing arm so as to permit the user to adjust the distance between the forward support surface and the metacenter axis; and a rear support member comprising a rear support surface for supporting a rear end of the rowing simulator, the rear support member being adjustably secured to the rear swing arm so as to permit the user to adjust the distance between the rear support surface and the metacenter axis, the forward support member and the rear support member being the sole means for supporting the weight of the rowing simulator on the lateral roll-simulating assembly, whereby to permit the user to adjust the lateral instability of a rowing simulator mounted to the lateral roll-simulating assembly.

2. A lateral roll-simulating assembly according to claim 1 further comprising a locking mechanism for locking at least one of the forward swing arm and the rear swing arm to at least one of the forward base member and the rear base member.

3. A lateral roll-simulating assembly according to claim 2 wherein the locking mechanism comprises a pin extending through at least one of the forward swing arm and the rear swing arm and extending through at least one of the forward base member and the rear base member.

4. A lateral roll-simulating assembly according to claim 1 further comprising a feedback mechanism for advising the user of the position of the forward swing arm relative to the forward base member.

5. A lateral roll-simulating assembly according to claim 4 wherein the feedback mechanism comprises a visual indicator.

6. A lateral roll-simulating assembly according to claim 5 wherein the visual indicator comprises a gauge plate attached to the forward base member and a finger attached to the forward swing arm.

7. A lateral roll-simulating assembly according to claim 1 further comprising a counterweight secured to at least one of the forward swing arm and the rear swing arm.

8. A lateral roll-simulating assembly according to claim 7 wherein the counterweight is adapted to compensate for any asymmetrical weight distribution in the rowing simulator.

9. A lateral roll-simulating assembly according to claim 1 wherein the front support member comprises at least one hole, the front swing arm comprises at least one hole, and further wherein the front support member is adjustably secured to the front swing arm by means of a removable pin extending through the holes, and further wherein the rear support member comprises at least one hole, the rear swing arm comprises at least one hole, and further wherein the rear support member is adjustably secured to the rear swing arm by means of a removable pin extending through the holes.

10. A lateral roll-simulating assembly according to claim 9 wherein the front support member comprises a plurality of holes, the front swing arm comprises a plurality of holes, and further wherein the front support member is adjustably secured to the front swing arm by means of a removable pin extending through the holes, and further wherein the rear support member comprises a plurality of holes, the rear swing arm comprises a plurality of holes, and further wherein the rear support member is adjustably secured to the rear swing arm by means of a removable pin extending through the holes.

11. A lateral roll-simulating assembly according to claim 1 wherein the front support member and the front swing arm are disposed in telescoping relation, and further wherein the rear support member and the rear swing arm are disposed in telescoping relation.

12. Apparatus for simulating an on-water rowing experience, the apparatus comprising:

a rowing simulator; and a lateral roll-simulating assembly for supporting the rowing simulator, the lateral roll-simulating assembly comprising:

a forward base member having a forward swing arm pivotally connected thereto at a forward pivot, and a rear base member having a rear swing arm pivotally connected thereto at a rear pivot, the forward pivot and the rear pivot together defining a metacenter axis;

a forward support member comprising a forward support surface for supporting a forward end of the rowing simulator, the forward support member being adjustably secured to the forward swing arm so as to permit the user to adjust the distance between the forward support surface and the metacenter axis; and a rear support member comprising a rear support surface for supporting a rear end of the rowing simulator, the rear support member being adjustably secured to the rear swing arm so as to permit the user to adjust the distance between the rear support surface and the metacenter axis, the rowing simulator being supported on the forward support surface and the rear support surface, the forward support member and the rear support member being the sole means for supporting the weight of the rowing simulator on the lateral roll-simulating assembly, whereby to permit the user to adjust the lateral instability of the rowing simulator mounted to the lateral roll-simulating assembly.

13. Apparatus according to claim 12 further comprising a locking mechanism for locking at least one of the forward swing arm and the rear swing arm to at least one of the forward base member and the rear base member.

14. Apparatus according to claim 13 wherein the locking mechanism comprises a pin extending through at least one of the forward swing arm and the rear swing arm and extending through at least one of the forward base member and the rear base member.

15. Apparatus according to claim 12 further comprising a feedback mechanism for advising the user of the position of the forward swing arm relative to the forward base member.

16. Apparatus according to claim 15 wherein the feedback mechanism comprises a visual indicator.

17. Apparatus according to claim 16 wherein the visual indicator comprises a gauge plate attached to the forward base member and a finger attached to the forward swing arm.

18. Apparatus according to claim 12 further comprising a counterweight secured to at least one of the forward swing arm and the rear swing arm.

19. Apparatus according to claim 18 wherein the counterweight is adapted to compensate for any asymmetrical weight distribution in the rowing simulator.

20. Apparatus according to claim 12 wherein the front support member comprises at least one hole, the front swing arm comprises at least one hole, and further wherein the front support member is adjustably secured to the front swing arm by means of a removable pin extending through the holes, and further wherein the rear support member comprises at least one hole, the rear swing arm comprises at least one hole, and further wherein the rear support member is adjustably secured to the rear swing arm by means of a removable pin extending through the holes.

21. Apparatus according to claim 20 wherein the front support member comprises a plurality of holes, the front swing arm comprises a plurality of holes, and further wherein the front support member is adjustably secured to the front swing arm by means of a removable pin extending through the holes, and further wherein the rear support member comprises a plurality of holes, the rear swing arm comprises a plurality of holes, and further wherein the rear support member is adjustably secured to the rear swing arm by means of a removable pin extending through the holes.

22. Apparatus according to claim 12 wherein the front support member and the front swing arm are disposed in telescoping relation, and further wherein the rear support member and the rear swing arm are disposed in telescoping relation.

23. A method for developing the lateral balance skills useful in an on-water rowing experience, the method comprising:

providing apparatus for simulating an on-water rowing experience, the apparatus comprising:

a rowing simulator; and a lateral roll-simulating assembly for supporting the rowing simulator, the lateral roll-simulating assembly comprising:

a forward base member having a forward swing arm pivotally connected thereto at a forward pivot, and a rear base member having a rear swing arm pivotally connected thereto at a rear pivot, the forward pivot and the rear pivot together defining a metacenter axis;

a forward support member comprising a forward support surface for supporting a forward end of the rowing simulator, the forward support member being adjustably secured to the forward swing arm so as to permit the user to adjust the distance between the forward support surface and the metacenter axis; and a rear support member comprising a rear support surface for supporting a rear end of the rowing simulator, the rear support member being adjustably secured to the rear swing arm so as to permit the user to adjust the distance between the rear support surface and the metacenter axis, the rowing simulator being supported on the forward support surface and the rear support surface, the forward support member and the rear support member being the sole means for supporting the weight of the rowing simulator on the lateral roll-simulating assembly, whereby to permit the user to adjust the lateral instability of the rowing simulator mounted to the lateral roll-simulating assembly;

securing the forward support member to the forward swing arm, and securing the rear support member to the rear swing arm, so that the forward support member and the rear support member are displaced from the metacenter by a first distance;

operating the rowing simulator; and re-securing the forward support member to the forward swing arm, and re-securing the rear support member to the rear swing arm, so that the forward support member and the rear support member are displaced from the metacenter by a second distance, the second distance being different than the first distance.

24. A method according to claim 23 wherein the apparatus further comprises a visual indicator to show the user the tilt of the rowing simulator, and further wherein operating the rowing simulator comprises observing the visual indicator while performing the rowing motion.

25. A lateral roll-simulating assembly for supporting a rowing simulator, the lateral roll-simulating assembly comprising:

a first base member having a first support member movably connected to the first base member about a first pivot point, the first support member being adapted to support a first end of the rowing simulator;

a second base member having a second support member movably connected to the second base member about a second pivot point, the second support member being adapted to support a second end of the rowing simulator;

the first pivot point and the second pivot point together defining a metacenter axis;

the first support member and the second support member being the sole means for supporting the weight of the rowing simulator on the lateral roll-simulating assembly; and the first support member and the second support member being movable relative to the metacenter axis in order to permit the user to modify the position of the center of gravity of the user and the rowing simulator relative to the metacenter axis, whereby to the adjust the lateral instability of the rowing simulator mounted to the lateral roll-simulating assembly.

26. A method for developing the lateral balance skills useful in an on-water rowing experience, the method comprising:

providing apparatus for simulating an on-water rowing experience, the apparatus comprising:

a rowing simulator; and a lateral roll-simulating assembly for supporting a rowing simulator, the lateral roll-simulating assembly comprising:

a first base member having a first support member movably connected to the first base member about a first pivot point, the first support member being adapted to support a first-end of the rowing simulator;

a second base member having a second support member movably connected to the second base member about a second pivot point, the second support member being adapted to support a second end of the rowing simulator;

the first pivot point and the second pivot point together defining a metacenter axis;

the rowing simulator being supported on the first support member and the second support member, the first support member and the second support member being the sole means for supporting the weight of the rowing simulator on the lateral roll-simulating assembly; and the first support member and the second support member being movable relative to the metacenter axis in order to permit the user to modify the position of the center of gravity of the user and the rowing simulator relative to the metacenter axis, whereby to the adjust the lateral instability of the rowing simulator mounted to the lateral roll-simulating assembly;

positioning the first support member and the second support member in a first position relative to the metacenter axis, wherein the first support member and the second support member are spaced from the metacenter axis by a first distance, and positioning the first end of the rowing simulator on the first support member, and positioning the second end of the rowing simulator on the second support member;

operating the rowing simulator; and re-positioning the first support member and the second support member in a second position relative to the metacenter axis, wherein the first support member and the second support member are spaced from the metacenter axis by a second distance, the second distance being different than the first distance.

* * * * *